United States Patent [19]

Berger

[11] 4,297,880

[45] Nov. 3, 1981

[54] DOWNHOLE PRESSURE MEASUREMENTS OF DRILLING MUD

[75] Inventor: Eugene L. Berger, Houston, Tex.

[73] Assignee: General Electric Company, Philadephia, Pa.

[21] Appl. No.: 119,041

[22] Filed: Feb. 5, 1980

[51] Int. Cl.[3] ..... E21B 47/10

[52] U.S. Cl. ..... 73/155

[58] Field of Search ..... 73/155, 151, 714, 716, 73/438; 175/48

[56] References Cited

U.S. PATENT DOCUMENTS 2,924,432 2/1960 Arps et al. ..... 73/151

3,422,672 1/1969 Payne ..... 73/151

*Primary Examiner*—Jerry W. Myracle

*Attorney, Agent, or Firm*—Allen E. Amgott; Raymond H. Quist

[57] ABSTRACT

Pressure measurements of drilling mud inside the drill string and outside by transducers mounted in an instrumentation sub near the drill bit provide rapid notice of the instrusion of fluids or solids into the borehole and also permit appropriate adjusting of the mud pumping pressure.

4 Claims, 4 Drawing Figures

DOWNHOLE PRESSURE MEASUREMENTS OF DRILLING MUD

BACKGROUND OF THE INVENTION

This invention relates generally to sensing while drilling, and more particularly to measuring pressures in drilling mud.

U.S. Pat. No. 2,290,408 of Wilbur J. Crites has a detailed description of problems which may occur as well drill bit chews its way through various geological formations. One problem is the intrusion into the well bore of gas or liquid which lowers the density of the drilling mud and is therefore a precursor of a potential blowout. A second problem occurs when the mud fails to cake properly on the wall of the well bore permitting the intrusion of sand and possibly resulting in an accumulation of sand and cuttings sufficient to bind the drill string. Sand intrusion usually results in increased drilling mud density.

The Crites patent proposed to measure the difference in volume between the drilling mud which was pumped down the hole and that which returned as an indicator of potential trouble. Without questioning the effectiveness of Crites' approach in 1941, it is evidently inadequate when well bore depths of 10 and 20 thousand feet are involved because of the time which will have elapsed when the drilling mud reaches the surface.

In addition to the foregoing problems, efficient operation of the drill bit requires flushing of the media broken up by the bit off of the bit so as not to reduce its drilling capability. This is accomplished by having the drilling mud passing through the drill string at a sufficiently high pressure so that it passes through the nozzles in the bit with suitable velocity and force. For different bits, different pressures may be desired. To ensure that the drilling mud is pumped down the drill string at the proper pressure it is necessary to know the actual pressure near the drill bit both inside the drill string and outside.

SUMMARY OF THE INVENTION

First and second pressure transducers are mounted in an instrumentation sub which is part of the drill string and preferably near the drill bit. One of the transducers is exposed to the pressure of the drilling mud being pumped down the drill string, while the other is exposed to the pressure of the mud outside the drill string. In the alternative, one of the transducers may be a differential pressure transducer. Signals produced by the transducer are delivered to an instrumentation package contained in the instrumentation sub.

DESCRIPTION OF THE PREFERRED EMBODIMENT

Figure 1:
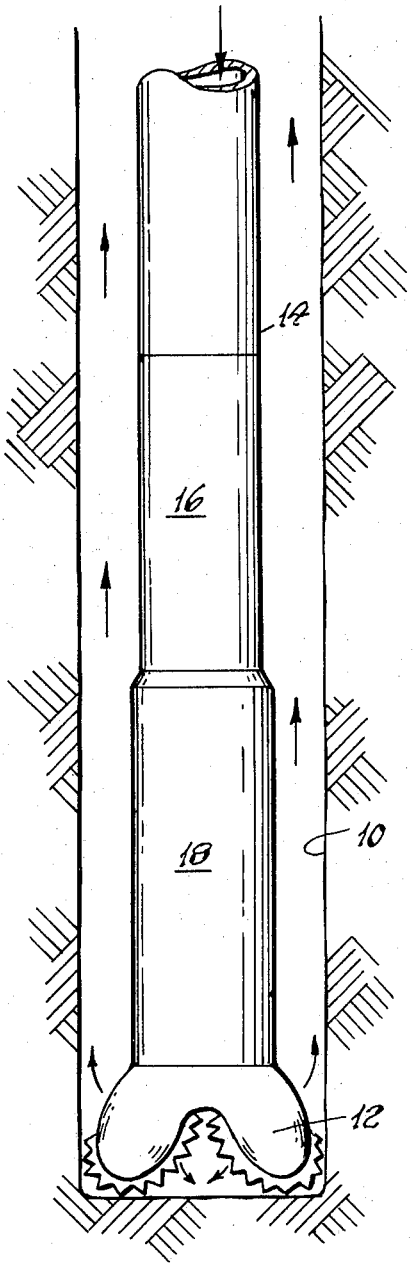
FIG. 1 shows schematically a portion of a drill string in a borehole.

Referring to FIG. 1, borehole 10 is drilled by bit 12 in the conventional manner. Drilling mud, the path of which is indicated by the arrows, is pumped down the interior of drill string 14, out through bit 12 and then passes upwardly between drill string 14 and the walls of borehole 10.

As is well known, the drilling mud is mixed to have a density sufficient to prevent entry of fluids into borehole 10 from the geological formations through which the borehole passes. In addition, the drilling mud is designed to form a coating or cake on the walls of the borehole so that sand or the like will not fall into the borehole.

In the event there is, never-the-less, an intrusion of sand or fluids into borehole 10, a rapid indication of this event is desired at the surface. Instrumentation sub 16 is part of the drill string and may be located above drill collar 18. Instrumentation sub 16 may contain various types of transducers and a communication system whereby information derived from said transducers can be transmitted to the surface. Such a system is disclosed in U.S. Pat. No. 3,959,767, Smither et al.

Figure 2:
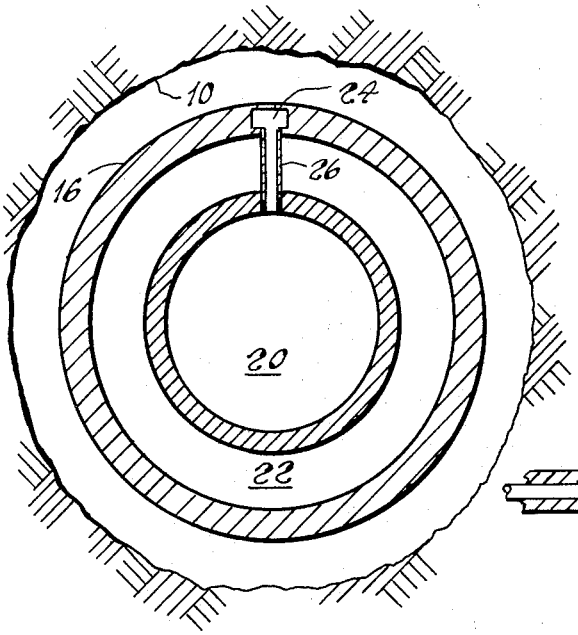
FIG. 2 shows in cross section an instrumentation sub.

Referring now to FIG. 2, instrumentation sub 16 is shown within borehole 10 and having a centrally located instrumentation package 20. Drill pipe bore 22 provides a passage for the drilling mud being pumped down the drill string. Cavity 24, in the wall of instrumentation sub 16, is shown connected by tube 26 to instrumentation package 20.

Figure 3:
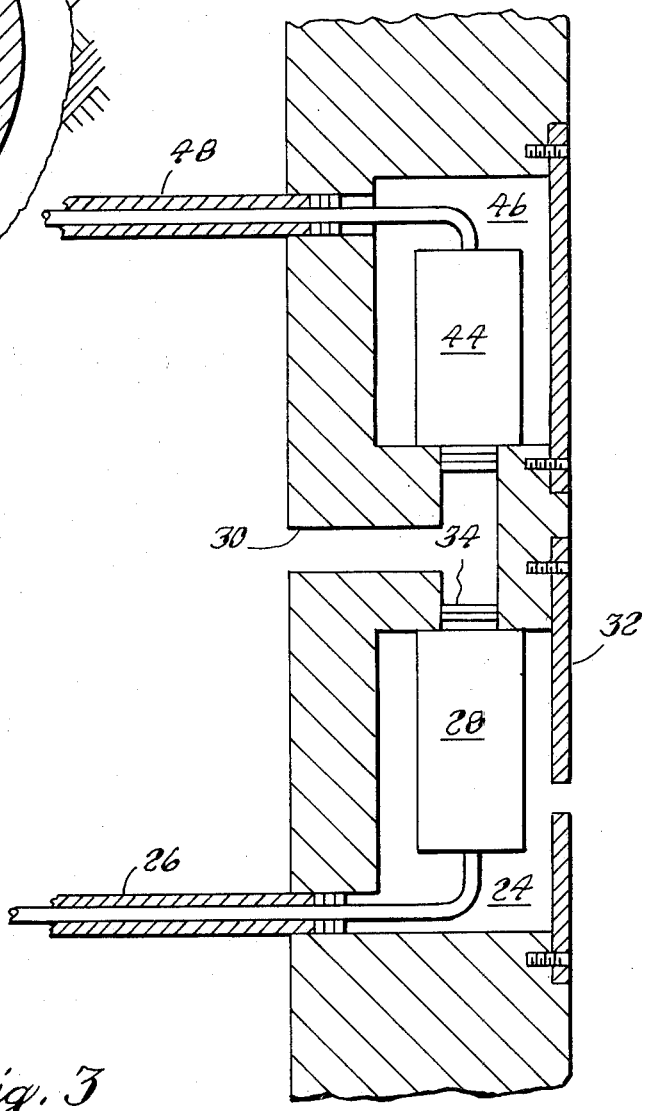
FIG. 3 shows, partially in section, a portion of the wall of the instrumentation sub with the transducers of this invention.

As shown in FIG. 3, cavity 24 has mounted therein differential pressure transducer 28. Differential pressure transducer 28 is mounted so that it is exposed to both the pressure within the annulus 22 (FIG. 2) by means of passageway 30, and the pressure outside instrumentation sub 16 by means of one or more holes in cover plate 32. A non-electrical conducting grease may be provided in cavity 24 to protect transducer 28. Gaskets 34 or a bladder may be used for the same purpose.

In addition to differential pressure transducer 28 it is frequently desirable to have an absolute pressure measurement ("absolute" in this sense refers to an actual pressure measurement rather than a difference in pressures measurement). Pressure transducer 44 is mounted in cavity 46 so as to be exposed to the pressure in passage 30. The signal produced by pressure transducer 44 is carried by a conductor in tube 48 to instrumentation package 20.

Figure 4:
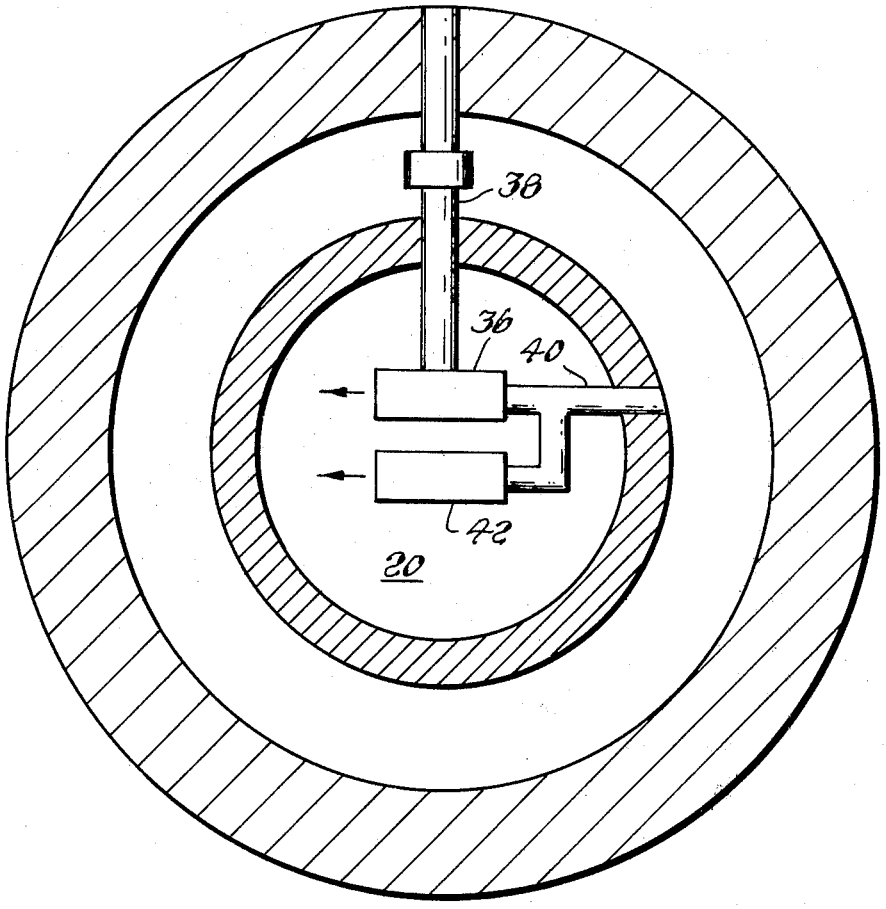
FIG. 4 shows an alternative positioning of the transducers.

An alternative embodiment is illustrated in FIG. 4 wherein differential pressure transducer 36 is mounted within instrumentation package 20 and is provided with tubes 38 and 40 which transmit the desired pressures. Note that an absolute pressure transducer 42 is also used in this location.

Communication of the pressure signals to the surface such as by the Smither et al system, previously cited, permits constant monitoring. This mud density may be modified, pumping pressure adjusted or drilling halted, as appropriate, in a timely manner is possible.

Although particular embodiments of apparatus for measuring the pressure of drilling mud have been illustrated and described, it will be evident that changes and modifications can be made without departing from the spirit of the invention and the scope of the appended claims.

I claim:

1. Intrusion detection means for detecting the intrusion into a well bore of material having a density different from that of the drilling mud comprising:

a drill string having an instrumentation sub as a part thereof;

said instrumentation sub having a passage for drilling mud therein;

a first pressure transducer in said instrumentation sub exposed to the pressure of the drilling mud in said passage and producing an electrical signal representative thereof; and a second pressure transducer in said instrumentation sub exposed to the pressure of the drilling mud outside said instrumentation sub and producing an electrical signal representative thereof.

2. Apparatus in accordance with claim 1 wherein: said first and second pressure transducers are located in the wall of said instrumentation sub.

3. Apparatus in accordance with claim 1 wherein: said first and second pressure transducers are located in an instrumentation package in said instrumentation sub.

4. Apparatus in accordance with claims 2 or 3 wherein: said second pressure transducer is a differential pressure transducer which is also exposed to the pressure of the drilling mud in said passage.

* * * * *